United States Patent [19]

Haubner et al.

[11] Patent Number: 4,515,118

[45] Date of Patent: May 7, 1985

[54] MAGNETO IGNITION SYSTEM, PARTICULARLY FOR ONE-CYLINDER INTERNAL COMBUSTION ENGINES

[76] Inventors: Georg Haubner, Ludwigstrasse 1, D-8431 Berg; Hans-Dieter Schmid, Kamenzerstrasse 8, D-8500 Nürnberg, both of Fed. Rep. of Germany

[21] Appl. No.: 622,133

[22] Filed: Jun. 19, 1984

[30] Foreign Application Priority Data

Jul. 13, 1983 [DE] Fed. Rep. of Germany ..... 3325275

[51] Int. Cl.[3] ..... F02P 1/08

[52] U.S. Cl. ..... 123/149 C; 123/417

[58] Field of Search ..... 123/417, 416, 415, 149 C, 123/602

[56] References Cited

U.S. PATENT DOCUMENTS 4,378,769 4/1983 Haubner et al. ..... 123/416

4,462,356 7/1984 Hirt ..... 123/149 C

FOREIGN PATENT DOCUMENTS 58-5470 1/1983 Japan ..... 123/602

*Primary Examiner*—Andrew M. Dolinar

[57] ABSTRACT

To provide operating energy to an ignition instant control circuit, for example a microprocessor (22) which controls operation of a semiconductor switching stage (20) without detracting from the energy output of the magneto coil (14), the energy in the voltage half-wave (negative) which does not supply ignition energy is used to charge a storage capacitor (24) to a charging network (25, 26), with a limit being determined by a Zener diode (29); the ignition instant is calculated by the control circuit, typically a microprocessor (22), which receives operating energy from across the capacitor, and a control input at a control terminal (30) which is connected to an insulated gate semiconductor switch, typically an MOS-FET (31) having its drain (D) connected to the control terminal (30) of the microprocessor and through a coupling capacitor to the output terminal (24*a*) of the energy supply circuit; its source (S) connected to that one of the ignition winding terminals (14*a*) which is common to the energy supply circuit and the terminal of the capacitor (24) remote from the output voltage supply terminal (24*a*); and the gate (G) of which is controlled through a coupling network (33, 34, 35, 36) connected across the primary winding (14) of the magneto.

9 Claims, 4 Drawing Figures

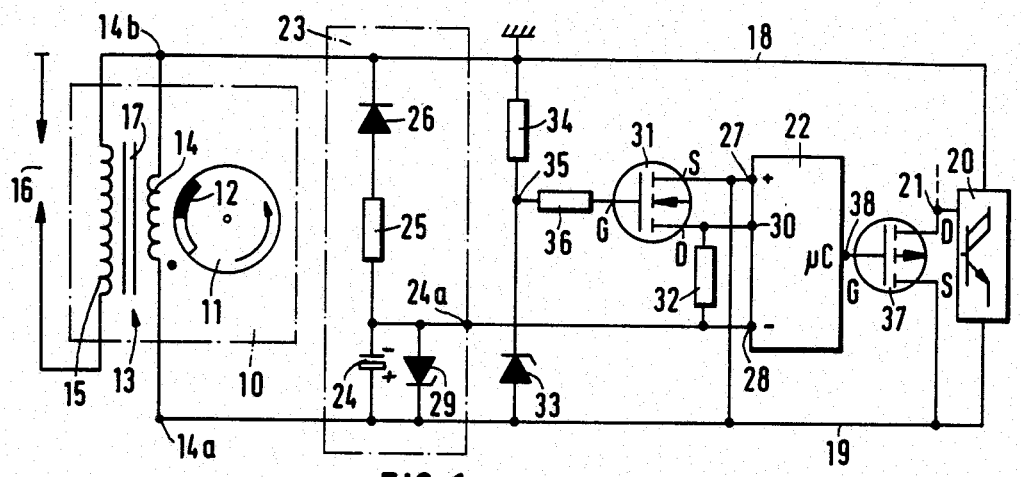
FIG. 1
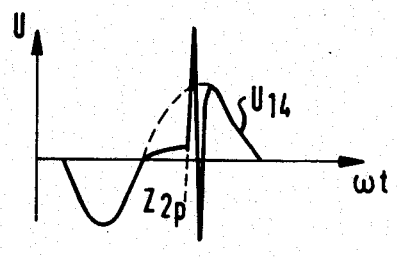
FIG. 3
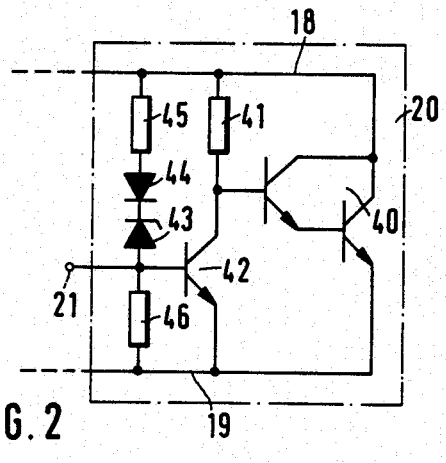
FIG. 2
FIG. 4
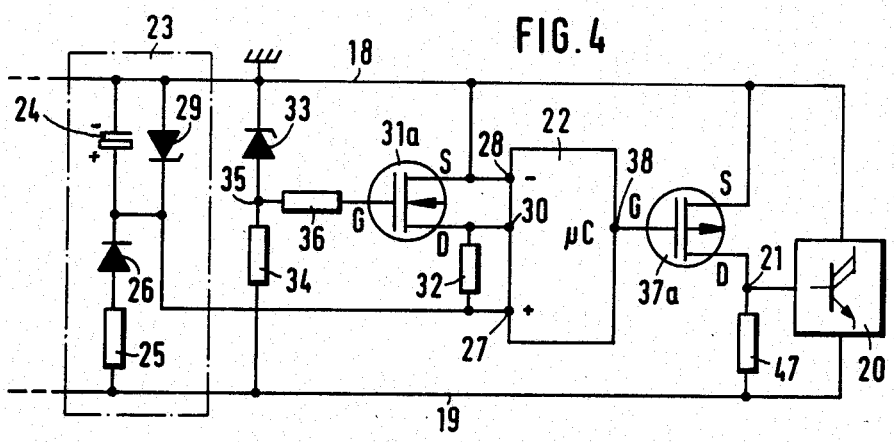

MAGNETO IGNITION SYSTEM, PARTICULARLY FOR ONE-CYLINDER INTERNAL COMBUSTION ENGINES

The present invention relates to a magneto ignition system, and more particularly to an ignition system to control the ignition of a single spark plug of an internal combustion engine (ICE), for example of a single-cylinder ICE of the type used in chain saws and similar gasoline-engine driven apparatus, lawnmowers, and the like.

BACKGROUND

Various types of circuits for control of the ignition instant of small gasoline engines have been proposed. Once such circuit uses a microprocessor which requires operating power, the operating power being derived from a storage stage which is coupled to the primary winding of the magneto. Those half-waves which are used to provide ignition energy are also used to provide energy to operate the control system, typically the microprocessor (see, for example, German Patent Disclosure Document DE-OS No. 30 06 228). Half-waves which are used to provide ignition energy are additionally applied to the control input of the microprocessor and furnish a speed signal as well as a reference signal in order to calculate the optimum ignition instant. This type of circuit has the advantage that the speed and reference signals, respectively, which are applied to a control input of the microprocessor will have the same polarity as the supply voltage applied to the microprocessor. It has been found, however, that the voltage supply of the microprocessor can be impaired when the engine operates at idling speed since the half-waves derived from the magneto generator winding, until the ignition time instant, are essentially short-circuited by the closed breaker switch, typically a transistor, of the transistorized ignition circuit. Consequently, voltage supply for the microprocessor is not insured and, particularly at low speeds, must be increased, which may require additional circuitry, or increase of the idling speed of the ICE merely in order to supply sufficient operating voltage to the microprocessor or similar control system therein. Otherwise, accurate firing of the spark plug, at the desired instant, may not be controllable.

THE INVENTION

It is an object to provide an energy supply circuit for an ignition instant control system, typically a microcomputer, installed in the ignition system of an ICE which provides adequate supply voltage even at low speeds of the engine, typically under idling speed, and to insure accurate control of the ignition instant over the entire speed range, from idling speed to maximum speed, of the engine.

Briefly, a diode coupling network is provided, which includes at least one diode which is polarized reversely with respect to the main current carrying path of the ignition semiconductor switch, typically a Darlington transistor. The diode coupling circuit is connected with one input to the energy supply circuit and to a terminal of the primary winding of the ignition coil of the magneto. Another terminal of the ignition coil of the magneto is connected to another terminal of the energy input circuit, as well as to an output terminal thereof. An insulated gate semiconductor switch, typically a metal-oxygen-silicon-field effect transistor (MOS-FET) and a load resistor are provided, the switch having its switching path connected in parallel with the output of the energy supply circuit, one output terminal being connected to the control input of the ignition instant control circuit, and the gate thereof being connected to one of the terminals of the primary winding. Another output terminal of the primary winding is connected to one of the energy supply terminals, so that the primary winding is connected with one terminal to both the energy supply terminal of the control circuit and to an input of the energy supply circuit.

The system has the advantage that those half-waves derived from the generator winding, that is, typically the primary winding of the magneto coil, which are not loaded by the ignition energy, are available to charge the energy supply circuit, typically a storage capacitor which, then, will supply operating energy, at suitable voltage to the control circuit, typically a microprocessor. The system provides sufficient voltage already upon starting of the internal combustion engine (ICE) being supplied to the microprocessor.

The speeds and trigger signals which, now, will be poled oppositely with respect to the supply voltage, are so transformed by the insulated gate semiconductor—preferably an MOS-FET-that the speed and trigger signals can be readily accepted by the microprocessor.

In accordance with a preferred feature of the invention, a second insulated gate semiconductor switch is connected to the output of the microprocessor, the switching path thereof being connected to the control circuit of the ignition switching stage, typically a Darlington transistor, to thereby match the output signal of the microprocessor to the input of the ignition switching stage.

DRAWINGS

FIG. 1 is a general circuit diagram of the system in accordance with the invention;

FIG. 2 is a fragmentary detailed diagram showing the ignition switching stage itself;

FIG. 3 is a graph illustrating the voltage wave in the primary winding of the magneto generator of the system; and FIG. 4 is a fragmentary diagram illustrating a modification of the circuit illustrated in FIG. 1.

DETAILED DESCRIPTION

The circuit network of FIG. 1 is intended to supply ignition pulses to a single-cylinder ICE, of the portable type, typically for a chainsaw. It has a transistorized magneto ignition system, having a magneto 10. The magneto 10 includes a rotary magnet wheel 11, which has a magneto segment 12 generating a rotary magnetic field at the circumference of the wheel 11. An ignition armature 13 is secured to the housing of the ICE, for example, that is, is stationary with respect to the rotating wheel 11. Upon each revolution of the wheel 11, the magnetic field from the magnet segment 12 will pass through the armature unit 13. The armature unit 13 has a primary winding and a secondary winding 15. Secondary 15 is coupled with one end to the primary 14, and with the other by an ignition cable to the sparking terminal of a spark plug 16. The primary winding 14 and the secondary winding 15 form an ignition coil which is located on a core 17. The primary winding 14, thus, simultaneously functions as the generator winding with respect to the rotating magnet 12, and as the primary winding of the ignition coil.

The primary winding is connected by connection lines 18 and 19 to a primary circuit of the ignition system, which includes an ignition switch 20. The ignition switch 20 has a control input 21. A microprocessor 22 which, for example, may be of the type COP 311 by National Semiconductor. The microprocessor 20 requires energy supply.

In accordance with a feature of the invention, voltage is supplied to the microprocessor 22 by an energy supply circuit 23, formed by a capacitor 24 and a resistor 25, serially connected to form an R/C network, which, in turn, is serially connected with a diode 26. The positive terminal of capacitor 24 forms the input for the energy supply circuit as well as an output, being connected with one terminal 14*a* of the primary winding 14. The terminal 14*a*, forming the positive terminal for capacitor 24, likewise is connected to the positive input terminal 27 of the microprocessor 22. The negative terminal of capacitor 24 is connected to the second output 24*a* of the energy supply circuit 23 which, in turn, is connected to the negative terminal 28 of the microprocessor 22. The supply voltage is limited to a predetermined level, for example about 15 V, by a suitably dimensioned Zener diode 29, connected in parallel to capacitor 24 within the energy supply circuit 23.

In accordance with a feature of the invention, the diode 26 in the input to the energy supply stage 23 is poled oppositely to the current flow passing direction of the ignition switching stage 20. The diode 26 has its anode connected to the connection line 18 and hence to the terminal 14*b* of the primary winding 14.

In accordance with a feature of the invention, an insulated gate semiconductor switch 31 is connected to the control input terminal of the microprocessor 22. The switch 31 is a self-blocking MOS field effect transistor of the n-channel enrichment type. The switch has drain-source and gate terminals D, S, G. The drain-source terminals D, S form the main switching path of the field effect transistor (FER) 31, connected to the output of the energy supply circuit 23 through a load resistor 32, and to the bus 19, and hence to terminal 14*a* of the winding 14, respectively. The source terminal S is connected to the positive terminal of the microprocessor and, hence, to the bus 19. The control input 30 of the microprocessor 22 is connected directly to the data terminal D of the FET 31. The gate terminal G is connected through a voltage limiting stage formed by Zener diode 33 and coupling resistor 34, 36 connected at a junction 35 to the bus 18 and hence to the terminal 14*b* of the primary winding 14. The voltage limiting stage formed by the series circuit of Zener diode 33 and the resistor 34 is connected in parallel with the primary winding 14. The junction 35 between the Zener diode 33 and the resistor 34 is connected through coupling resistor 36 to the gate terminal G. The Zener diode 33 has its anode connected to the bus 19 and hence to the positive terminal of the microprocessor 22 and to the terminal 14*a* of the primary winding 14.

The output from the microprocessor 22 is connected, in accordance with a feature of the invention, with an MOS-FET 37 of the p-channel enrichment type. The switching path of the FET 37, that is, its drain-source terminal path, is connected across the ignition stage 20. The open drain terminal D is connected to the control input of the switching stage 20. FET 37 has its source terminal S connected to the bus 19 and hence to the terminal 14*a* of primary 14, and also to the positive terminal of the microprocessor 27.

The switching stage 20 is shown, in greater detail, in FIG. 2. It includes a Darlington ignition transistor 40, having its switching path in the primary circuit of the coil 14. Its collector is connected to bus 18, the emitter to the bus 19. The base terminal of the Darlington ignition transistor 40 is connected over coupling resistor 41 with the collector; the base-emitter control terminal of the Darlington transistor is bridged by the switching path of a control transistor 42, the emitter of which is connected to the emitter of the Darlington transistor 40. The base of the control transistor 42 forms the control input 21 for the ignition stage 20. It is connected by a Zener diode 43, an oppositely poled diode 44, and a resistor 45, with the bus 18; a coupling resistor 46 connects the terminal 21 to the bus 19. The diode 44 of the network branch is so polarized that the half-waves necessary for ignition derived from the primary winding 14 will pass through the diode 44, that is, the diode 44 is conductive with respect to those half-waves. The Zener diode 43, however, is oppositely polarized.

Operation, with reference to FIG. 3: The abscissa of FIG. 3 illustrates the course of the voltage in the primary winding 14 during one revolution of the wheel 11. The lower terminal 14*a* of the primary winding will be considered the reference terminal. As soon as the magnetic segment 12 approaches the armature 13, a negative voltage half-wave will arise in the primary winding which is highly damped by the circuit formed by the Zener diode 33 and resistor 34. The damping is strong that the remaining elements of the ignition circuit cannot be damaged by high voltage. The negative voltage half-wave further charges capacitor 24 of the energy supply stage 23 over resistor 25 and diode 26. It may, if the capacitor has not been entirely discharged, merely involve a recharge of the capacitor to the limit set by the Zener diode 33. The microprocessor 22, thus, will receive on its terminals 27, 28 a suitable supply voltage of, for example, from between 3.5 to 5 V. The Zener diode 29 which is connected in parallel to the capacitor 24 limits this supply voltage to a predetermined value, for example 5 V. The FET 31, since it will not have control voltage on its gate, will be blocked, so that the negative voltage of capacitor 24 is also applied over the load resistor 32 to the control input 30 of the microprocessor 22. The control output 38 of microprocessor 22 provides negative voltage, which causes the FET 37 to be conductive, thus placing the control input 21 of the ignition stage 20 at the voltage of the terminal 19. The control transistor 42 of the ignition stage 20 thus remains blocked.

As the wheel 11 continues to rotate, a positive voltage half-wave will be induced in the primary winding 14. This causes the ignition stage 20 to become conductive, since the Darlington transistor 40 will be controlled into conductive state over resistor 41, and primary current begins to flow. The primary voltage U14 will be limited to a few volts, however, due to the current through the coil damping the system. Diode 26 of the energy supply circuit 23 will be blocked for this voltage half-wave, so that the capacitor 24 cannot discharge and recharge in opposite direction. Resistors 34 and 36 couple the voltage from the winding 14 to the gate terminal G of the FET 31, which raises the gate voltage higher than the positive terminal at the source terminal of the FET 31, so that FET 31 will become conductive. Upon conduction of FET 31, control current derived from capacitor 24 will flow through the load resistor 32, and the control input 30 of the microprocessor 22 will have a positive voltage applied thereon. The ignition instant will now be calculated by the microprocessor in dependence on the speed of the ICE. Calculation of the actual ignition instant in a system of this type is well known, see, for example, German Patent Publication Document DE-OS No. 30 06 288. At the ignition instant $Z_{zp}$, the control output 38 will switch over from negative voltage to positive voltage of the voltage supply, so that the gate and source of the FET 37 will have the same voltage, causing FET 37 to block. The control transistor 43 of the ignition stage 20 is thus immediately changed to conductive state over resistor 45, diode 44 and Zener diode 43, thus bridging the control path of the ignition transistor 40, which abruptly interrupts the primary current through the primary coil 14. The secondary winding 15 will have a high voltage pulse appear thereat, which generates the spark at the spark plug or spark gap 16.

Due to the ignition event, the primary winding 14 will have an oscillating high voltage peak arise therein which, however, is limited by the Zener diodes 29 and 33, respectively.

At the end of the positive voltage half-wave U14, FET 31 connected to the control input of the microprocessor 22 will again block as the positive half-wave decays. The control output 38 of the microprocessor, upon switch-over to nagative voltage, will cause the FET 37 to become conductive, so that control transistor 42 in the ignition stage 20 again will block.

The process or cycle will repeat upon each revolution of the wheel 11.

Embodiment of FIG. 4: The system of FIG. 4 is similar to that of FIG. 1, and the same elements have been designated with the same reference numerals. Capacitor 24 is connected to the bus 18 with the upper terminal—with respect to the drawing—of the primary winding 14, hence with terminal 14*b;* the negative terminal 28 is connected to bus 18, and hence to terminal 14*b* of primary winding 14. The control input of the microprocessor 22 is connected to an inherently conductive MOS-FET 31*a,* which is an n-channel depletion type. The Zener diode 33 of the voltage limiter stage is connected with its cathode to the bus 18. The control output 38 of the microprocessor 22 is connected to a further MOS-FET 37*a,* of the p-channel depletion type. The source terminal of FET 37*a* is connected to the bus 18.

Operation: The negative voltage half-wave of the voltage U14 in the primary winding 14 to charge the capacitor 24 in the energy supply circuit 23 is used as voltage supply; the FET 31*a* at the input 30 of the microprocessor 22 is inherently conductive, and the FET 37*a* at the control output 38 is blocked by the positive voltage applied to its gate. The voltage at the connecting bus 19 is applied to the control input 21 of the ignition stage 20 over the resistor 47 in the drain connection. Upon beginning of the positive voltage half-wave, the gate voltage of the FET 31*a* will become negative with respect to the source voltage, and transistor 31*a* will block. This causes the voltage at the control input 30 of the microprocessor 21 to rise above the voltage at the control input 30 thereof, by conduction via load resistor 32. The microprocessor now calculates the ignition instant and provides, at the ignition instant $Z_{zp}$, the negative voltage of its supply to its control output 38, which causes the FET 37*a* to become conductive. The voltage at the terminal 18 is switched over the FET 37*a* to the control input 21 of the ignition stage 20 so that the ignition event, as explained in connection with FIG. 1, will be commanded.

Various changes and modifications may be made, and the invention is not limited to the embodiments illustrated. The ignition stage 20 can be entirely differently constructed; the microprocessor 22 as well as the ignition energy supply circuit 23 may be different. Rather than using FETs, other circuit elements, preferably switching without energy consumption, such as opto couplers or the like may be used. A magneto generator with a separate ignition winding can be used instead of a single magneto coil—generator winding combination. The feature of the invention, that the generator half-wave which is not used for ignition and generated within the primary circuit is used to supply voltage to the energy supply circuit which will energy the microprocessor is retained. The energy which is available during the half-wave when ignition is to be commanded will be available entirely for the ignition spark itself. The generator half-waves available for ignition will be so changed by the input circuit—and, preferably, also by the output circuit—connected to the control input of the microprocessor that they can function simultaneously as speed and reference signal to determine the ignition instant to be calculated in the microprocessor. Preferably, FETS are used which can be integrated at the input and output of the microprocessor therewith. They are shown separately in the circuit diagrams of FIGS. 1 and 4 only for better illustration of the system, and of the operation. It is also immaterial whether, as shown in FIGS. 1 and 3, the connection bus 18 is connected to chassis or ground of the device with which the system is to be used. Both embodiments of FIGS. 1 and 4 may, preferably, use a microprocessor of the type COP 311 of National Semiconductor.

Various other changes and modifications may be made, and any features described herein may be used with any of the others, within the scope of the inventive concept.

We claim:

1. Magneto ignition system to provide ignition pulses to a spark plug (16) of an internal combustion engine (ICE) and electrical operating energy for a control circuit (22) to control the ignition instant, having a magneto (10) including a rotating magnet (11, 12), a magneto coil (13) having a primary winding (14) and a secondary winding (15), the secondary winding being coupled to the spark plug;

an ignition instant control circuit (22) including a control input terminal (30) to connect to the primary winding (14), and a semiconductor switch (20) having a main current carrying path, serially connected to the primary winding;

an energy supply circuit (23) having an output coupled to supply operating energy to the ignition instant control circuit including a storage capacitor (24) and a diode coupling network (26) coupling one output terminal (14*b*) of the primary winding to the storage capacitor for storing electrical energy upon rotation of the magnet, wherein, in accordance with the invention, the diode coupling network (26) includes at least one diode (26) which is polarized reversely with respect to the main current carrying path of the semiconductor switch (20);

one input of the energy supply circuit (23) being connected to a terminal (e.g. FIG. 1: 14*a*) of the primary winding;

an insulated gate semiconductor switch (31) and a load resistor (32) are provided, the switching path of the insulated gate semiconductor switch being connected in parallel to the output (e.g. FIG. 1: 14*a*, 24*a*) of the energy supply circuit, the output (D) of the insulated gate semiconductor switch (31) being connected to a control input (30) of the ignition instant control circuit (22), and the gate (G) of the insulated gate semiconductor switch (31) being connected to one of the terminals (e.g. FIG. 1: 14*b*) of the primary winding (14);

and another one (e.g. FIG. 1: 14*a*) of the terminals of the primary winding being connected to an energy supply terminal (e.g. FIG. 1: 27) of the ignition instant control circuit (22), so that the another one terminal (14*a*) of the primary winding (14) is connected both to said energy supply terminal (27) of the ignition instant control circuit (22) and to said input of the energy supply circuit (23).

2. System according to claim 1, wherein the insulated gate semiconductor switch (31, 31*a*) comprises an MOS-FET having its drain (D) connected to the control input of the ignition instant control circuit (22);

a load resistor (32) coupling the drain (D) with a voltage supply terminal (e.g. FIG. 1: 28) of the ignition instant control circuit (22), the source terminal (S) of the MOS-FET being connected with another one of the energy supply terminals (FIG. 1: 27) of the ignition instant control circuit;

and a voltage limiting stage (33, 34) connecting across the output terminals (14*a*, 14*b*) of the primary winding (14), the voltage limiting terminal providing operating voltage, the gate (G) of the MOS-FET being coupled (36) to said operating voltage as applied by the voltage limiting stage.

3. System according to claim 2, wherein the voltage limiting stage comprises a branch including a Zener diode (33) and a serially connected resistor (34) forming, with the Zener diode, a junction, the branch being connected in parallel to the primary winding (14);

and a coupling resistor (36) connected between the junction (35) and the gate (G) of the MOS-FET.

4. System according to claim 3, wherein the Zener diode (33) is connected in current-conductive direction which is the same as said diode network (26), the Zener diode damping the voltage half-waves derived from the primary winding (14) of the magneto coil and damping the voltage half-waves of the primary winding, which half-waves are opposite the half-waves utilized to provide ignition energy to the spark plug (16).

5. System according to claim 1, wherein the energy supply circuit (23) comprises a series circuit including the capacitor (24), a resistor (25), and the diode network (26);

a Zener diode (29) connected in parallel to the capacitor, one of the Zener diode—capacitor parallel connections forming a common input-and-output terminal of the energy supply circuit, the other parallel connection of the Zener diode-capacitor forming the output terminal of the energy supply circuit and being connected to one (e.g. FIG. 1: 28) of the energy supply terminals of the energy supply circuit.

6. System according to claim 5, wherein the capacitor is a polarized capacitor and has its positive terminal connected to one (e.g. FIG. 1: 14*a*) of the terminals of the primary winding (14), the negative terminal of the capacitor being connected to the negative terminal (28) of the ignition instant control circuit (22).

7. System according to claim 5, wherein the capacitor is a polarized capacitor and has its negative terminal connected to one (FIG. 4: 14*b*) of the terminals of the primary winding (14);

and wherein the positive terminal of the capacitor (24) is connected to the positive terminal (27) of the ignition instant control circuit.

8. System according to claim 1, further including an additional insulated gate semiconductor switch (37, 37*a*) connected to a control output terminal (38) of the ignition instant control circuit (22), the switching path (D-S) of said additional insulated gate controlled switch being connected to control the conduction, and turn-off of said semiconductor switch (20).

9. System according to claim 8, wherein said additional insulated gate semiconductor switch (37, 37*a*) comprises an MOS-FET, having its gate (G) connected to the control output terminal (38) of the energy supply circuit (22), its source terminal (S) to one of the terminals (FIG. 1: 14*a*) of the primary winding and its drain terminal (D) with the control input (21) of the semiconductor switch (20).

* * * * *

UNITED STATES PATENT AND TRADEMARK OFFICE

CERTIFICATE OF CORRECTION

PATENT NO. : 4,515,118

DATED : May 7, 1985

INVENTOR(S) : Georg HAUBNER and Hans-Dieter SCHMID

It is certified that error appears in the above-identified patent and that said Letters Patent is hereby corrected as shown below:

In the heading, please add:

[73] Assignee: Robert Bosch GmbH
Stuttgart, Fed. Rep. of Germany

Signed and Sealed this

*Thirty-first* Day of *December 1985*

[SEAL]

*Attest:*

DONALD J. QUIGG

*Attesting Officer*

*Commissioner of Patents and Trademarks*